United States Patent [19]

Grady

[11] Patent Number: 4,807,269

[45] Date of Patent: Feb. 21, 1989

[54] APPARATUS FOR POWERING X-RAY TUBES

[76] Inventor: John K. Grady, 43 Slaugh Rd., Harvard, Mass. 01451

[21] Appl. No.: 34,096

[22] Filed: Apr. 2, 1987

[51] Int. Cl.[4] ..... H05G 1/12; H05G 1/10

[52] U.S. Cl. ..... 378/104; 378/101; 363/3

[58] Field of Search ..... 378/96, 97, 101, 104, 378/106, 108; 363/3, 4, 45, 149, ; 307/107

[56] References Cited

U.S. PATENT DOCUMENTS 4,255,668 3/1981 Harrison ..... 307/107

4,706,268 11/1987 Onodera ..... 378/106 X

*Primary Examiner*—Eugene R. Laroche

*Assistant Examiner*—David Mis

*Attorney, Agent, or Firm*—M. Lawrence Oliverio

[57] ABSTRACT

A high voltage power supply for an x-ray tube operating from a single phase alternating current source and including a phase shifter and/or solid state switch for providing first and second phase signals. Each of these signals or one of them are half-wave rectified. An output combining circuit provides for transformation to a high voltage while at the same time providing for additive combination of the signals from the half-wave rectifiers.

31 Claims, 8 Drawing Sheets

APPARATUS FOR POWERING X-RAY TUBES

BACKGROUND OF THE INVENTION

The present invention relates in general to an apparatus for powering x-ray tubes. More particularly, the invention relates to an improved high voltage single-phase power supply for providing x-ray exposures ranging from repetitive short duration x-ray exposures to continuous x-ray exposures.

At the present time it is common to employ a three-phase power supply to generate power for continuous x-ray generating tubes. These three-phase power supplies are generally complex in construction and costly. Generally speaking, in the past single-phase power supplies have not been employed because the voltage ripple from the rectified signal is too large causing the x-ray tube to produce a lower value x-ray energy than pure D.C. Filtering capacitors are generally impractical at the high voltages that are employed and interfere with switch on-switch off times. Thus, this has resulted in the use of only three-phase systems because these systems have less ripple; ripple being defined as the variation in the D.C. voltage as each phase in sequence contributes to the output voltage level.

The three-phase power supply is generally ineffective in operation when short duration x-ray exposures are desired. With the three-phase system, the x-ray tube is triggered when at least one power supply voltage phase is at a high level resulting in the generation of unwanted and interfering noise. A further limitation occurs when the x-ray image, which results when the x-ray passes through a body, is recorded onto a television-type camera tube. It should be noted here that some other device, such as a fluorescence material or image converter tube, is used between the x-rays and the TV camera to increase the sensitivity of the camera tube. TV circuits have well established sweep rates to which the x-ray exposure must be synchronized. If the exposure is not synchronized, the resulting picture from the TV-type camera has an interference pattern or jitters, which will make the picture very difficult or impossible to view. The exposure thus should be synchronized with the 60 Hz sweep rate to have a coherent picture. It is permissible to have the x-ray exposure be a less frequent multiple of the 60 Hz rate, for example, 30, 15, or 7.5 Hz. In each case, a coherent picture results. The three-phase systems presently being used can only be synchronized by other devices which are complex and costly, such as high voltage tetrodes or grid controlled x-ray tubes.

Also, when the three-phase system is used with short duration x-ray exposures, there are one or more of the phases which are not contributing energy to the x-ray tube. During these phases the high voltage transformer is susceptible to saturation of the transformer core which is highly undesirable.

Accordingly, it is an object of the present invention to provide an improved high voltage power supply which operates from a single-phase source at acceptable ripple levels.

Another object of the present invention is to provide an improved apparatus for powering x-ray tubes that enables operation with x-ray exposures arranging from repetitive short duration exposures to continuous exposures.

A further object of the present invention is to provide an improved high voltage power supply for x-ray generating tubes preferably operated from a single-phase power source and which is compatible with x-ray exposure detection apparatus such as a television-type camera tube.

Still another object of the present invention is to provide an improved high voltage power supply for x-ray generating tubes and which is characterized by suppression of the inverse high voltage cycle, thus permitting short exposures, yet resetting the magnetic core of the high voltage transformer is accomplished.

Another object of the present invention is to provide apparatus for generating x-ray exposures, which apparatus is characterized by improved simplicity, improved ripple factor and reduced cost.

SUMMARY OF THE INVENTION

To accomplish the foregoing and other objects, features and advantages of the invention, there is provided apparatus for supplying operating power to an x-ray generating source. More particularly, the invention relates to a high voltage x-ray tube power supply that is adapted to operate from a single-phase alternating current source and which produces a high voltage output that can be varied over a duty cycle of operation to provide varied x-ray exposure times over a range including repetitive short duration x-ray exposures to continuous x-ray exposures. Means are provided for receiving an input AC signal of first phase along with a means for shifting the phase of the first phase AC signal to thus provide a signal of second phase. A plurality of low voltage rectifier means are provided including at least first and second rectifier means. These rectifier means are preferably half-wave rectifier circuits. Means are provided for coupling the first phase signal to the first rectifier means and the second phase signal to the second rectifier means. A voltage transforming and combining means is provided coupled from the first and second rectifier means for combining the signals therefrom and providing a high voltage output signal for operating the x-ray generating source. Means are provided for adjusting the phase shift to thereby adjust the x-ray exposure time from the aforementioned repetitive short duration interval to a continuous interval. The voltage transforming and combining means may comprise a transformer means and an adder circuit means. The transformer means is coupled from the rectifier means and the adder circuit means is coupled from the transformer means to the x-ray generating source. The transformer means as well as the adder circuit means may be provided in first and second transformers and first and second adder circuits.

In the disclosed embodiment of the invention where the preferred half-wave rectifier circuit is employed, the positive going waveform of each signal is used for the x-ray exposure. If the phase angle that is employed is 90°, the total time available for an exposure is on the order of 12 milliseconds assuming a 60 Hz input power frequency. Because, with the use of half-wave rectifying circuits, there will be times when the output is at zero volts, the x-ray can be triggered at this time to reduce noise or transients. The zero crossing also permits synchronization to the sweep rates of standard TV cameras. This is especially important when TV cameras are the ultimate display for the x-ray image. The exposures may be carried out at 60, 30, 15, or 7.5 (or proportionately fewer) times per second and still be synchronized with the TV sweep rates. The relative phase angle may be changed to yield exposure times from on the order of 8 milliseconds to 12 milliseconds or more. In accordance with an alternate embodiment of the invention, a single phase signal may also be employed using a "phase back" technique so as to operate between 0.5 and 8 milliseconds.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

There is now described herein an apparatus, and more particularly embodied in a circuit, for generating power for an x-ray tube. The circuit of the present invention as illustrated in the block diagram of FIG. 1 has an input signal applied at terminal 10 that is a single-phase signal. For the sake of simplicity in FIG. 1 only single lines are illustrated. However, it is understood that the leads are actually paired leads. A more specific embodiment is described hereinafter in FIG. 3.

Figure 1:
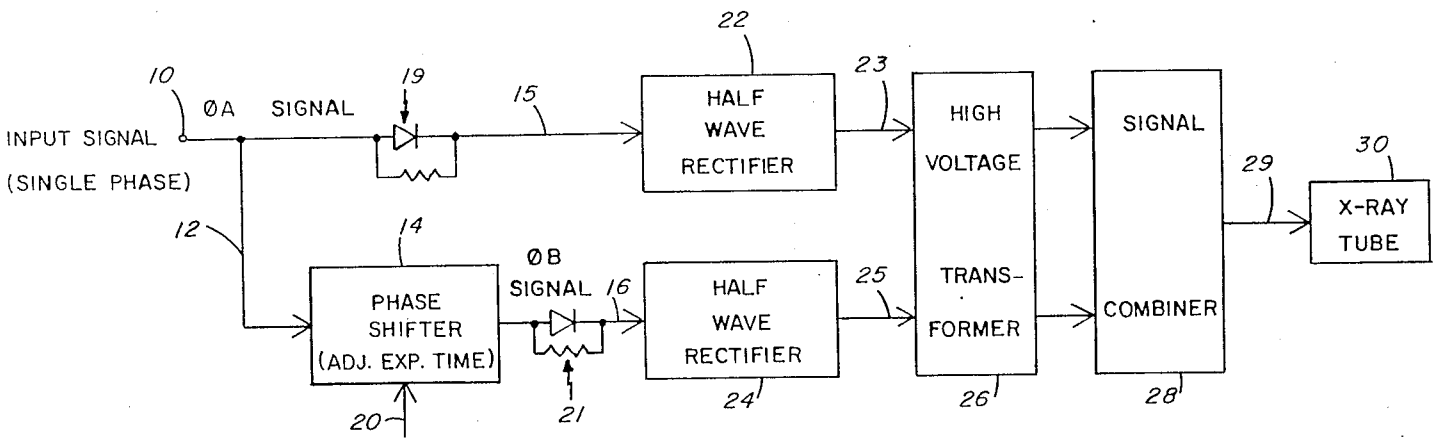
FIG. 1 is a block diagram of a high voltage power supply for use in generating power for x-ray tubes.

In essence, the power supply of the present invention generates two signals of the same frequency but of different phase angles, referred to in FIG. 1 and in FIGS. 2A–2D as phases A and B. These two phase-displaced signals are each half-wave rectified and then combined. The composite signal has a ripple component and duration which depends upon the relative phase angle. In essence, the trailing phase signal contributes a voltage level at the output as the first phase voltage level is decreasing. The amount that the output voltage drops before the second signal takes over depends upon the phase angle between the two signals. As the phase angle increases, the voltage drop increases and the duration of the output increases. When the phase angle decreases, the voltage drop decreases and the duration of the output decreases. This is noted in FIGS. 2A–2D by increased exposure times as the phase difference increases. This is discussed further hereinafter.

Figure 2A:
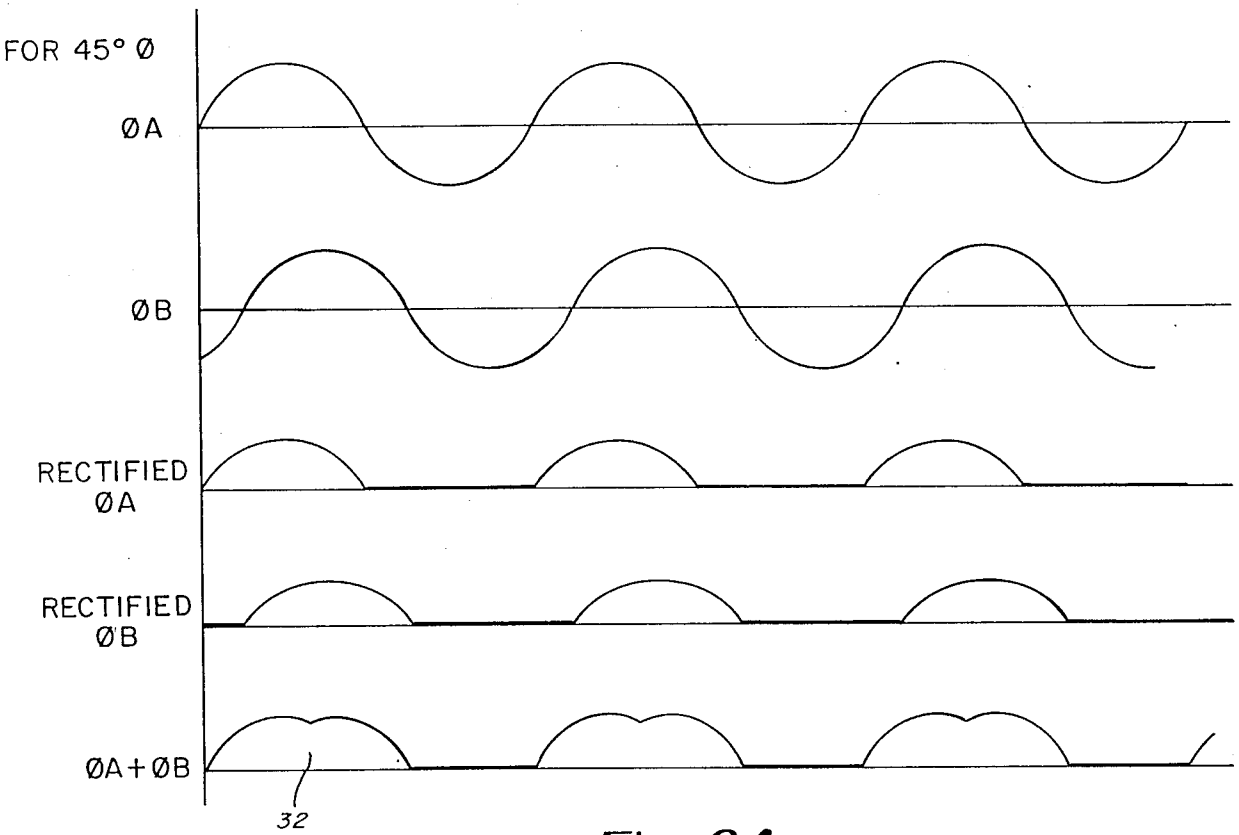
FIGS. 2A–2D are waveforms associated with the diagram of FIG. 1 illustrating different phase relationships established by the phase shifter of FIG. 1 and including respective phases of 45°, 90°, 135°, and 180°.

The system that is described herein is particularly useful where repetitive short-duration x-ray exposures are desired, i.e. digital television, fluoroscopy, or radiography at 7.5, 15, 30, or 60 frames per second. These rates are determined by the known parameters of television camera sweep systems and are synchronized with the zero points of the AC voltage wave. Again, note that with the use of a half-wave rectification technique, such as illustrated in FIG. 2A, there are zero crossing points that can be used for synchronization purposes with regard to detection.

With further reference to FIG. 1, as indicated previously, the input signal at terminal 10 is a single-phase signal. This may be at 230 volt ac. This signal is coupled by way of line 12 to the phase shifter 14. The phase shifter 14 is considered to be of conventional design and simply provides for a phase shift of this signal on line 12 so that a different phase signal appears at the output line 16. Although the phase has been altered, the frequency of the signals on lines 15 and 16 are the same. The frequency may be 60 Hz. Also illustrated in FIG. 1 is a further input to the phase shifter 14 illustrated at 20. This input simply illustrates the fact that the phase shifter 14 is one that is adjustable so that the phase of the signals between phase A and phase B may be adjusted. Once again, reference will be made to this adjustment of phase difference in connection with FIGS. 2A–2D.

Figure 3:
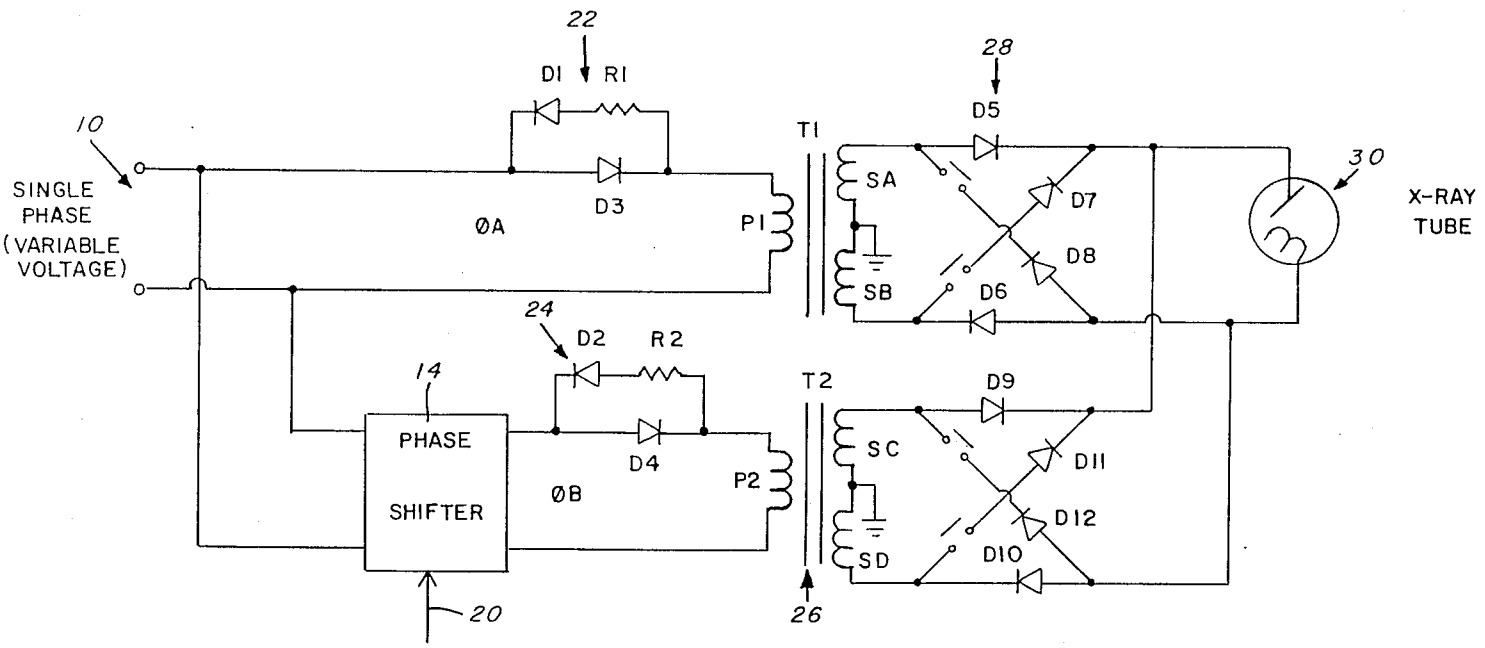
FIG. 3 is a more detailed diagram of a high voltage power supply that may be constructed in accordance with the present invention.
Figure 4:
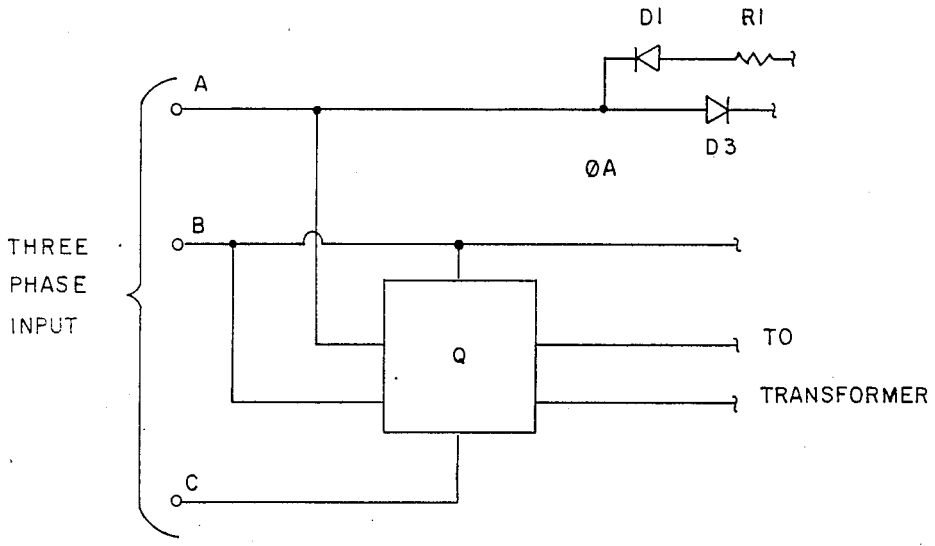
FIG. 4 shows an alternate embodiment of the invention operated from an input three phase signal.

The phase shifted signals may also be obtained in the manner illustrated in FIG. 4. This involves the use of a "Scott connection" transformer Q for converting from input three phase to two phase. In this connection in FIG. 4, the outputs may then couple to circuitry substantially identical to that illustrated in FIG. 3 including the half-wave rectifiers 22 and 24, respectively. The arrangement illustrated in FIG. 4 may provide a 90° two phase voltages from the input three phase supply.

FIG. 1 also illustrates a first half-wave rectifier 22 and a second half-wave rectifier 24. The phase A signal couples to the rectifier 22 and the phase B signal couples to the rectifier 24. The outputs from the rectifiers 22 and 24 couple on lines 23 and 25 to the high voltage transformer 26. The transformer 26 is shown coupling to a signal combiner 28 and the output of the signal combiner at line 29 couples to the x-ray tube 30.

FIG. 1 also illustrates the networks 19 and 21. The network 19 couples from the input terminal 10 to the half wave rectifier 22. The network 21 couples between the phase shifter 14 and the half wave rectifier 24. The diodes of each of these networks carries the load current to the rectifiers. The resistor of each of these networks limits the unloaded voltage and current.

The connections 23 and 25 illustrated in FIG. 1 may include a coupling by way of an adjustable auto transformer. This would provide a variable and adjustable voltage on each of the lines 23 and 25 to the high voltage transformer 26.

Reference is now made to FIGS. 2A–2D in connection with the circuit of FIG. 1. In each of the different phase relationships shown in FIGS. 2A–2D, it is noted that each separate diagram includes the phase A and phase B signals as well as the rectified signals, and finally also a combined signal. By way of example, FIG. 2A shows a phase difference of 45°. FIG. 2A shows the phase A and phase B signals which are the signals on lines 15 and 16 in FIG. 1. Next, illustrated in FIG. 2A are the rectified phase A and phase B signals. These would be the outputs at the half-wave rectifiers 22 and 24 at respective lines 23 and 25. Next, the final signal in FIG. 2A is a combination signal that is considered to be the output of the signal combiner 28 at line 29. This signal is an additive signal and is derived by essentially adding the rectified phase A and phase B signals.

Figure 2B:
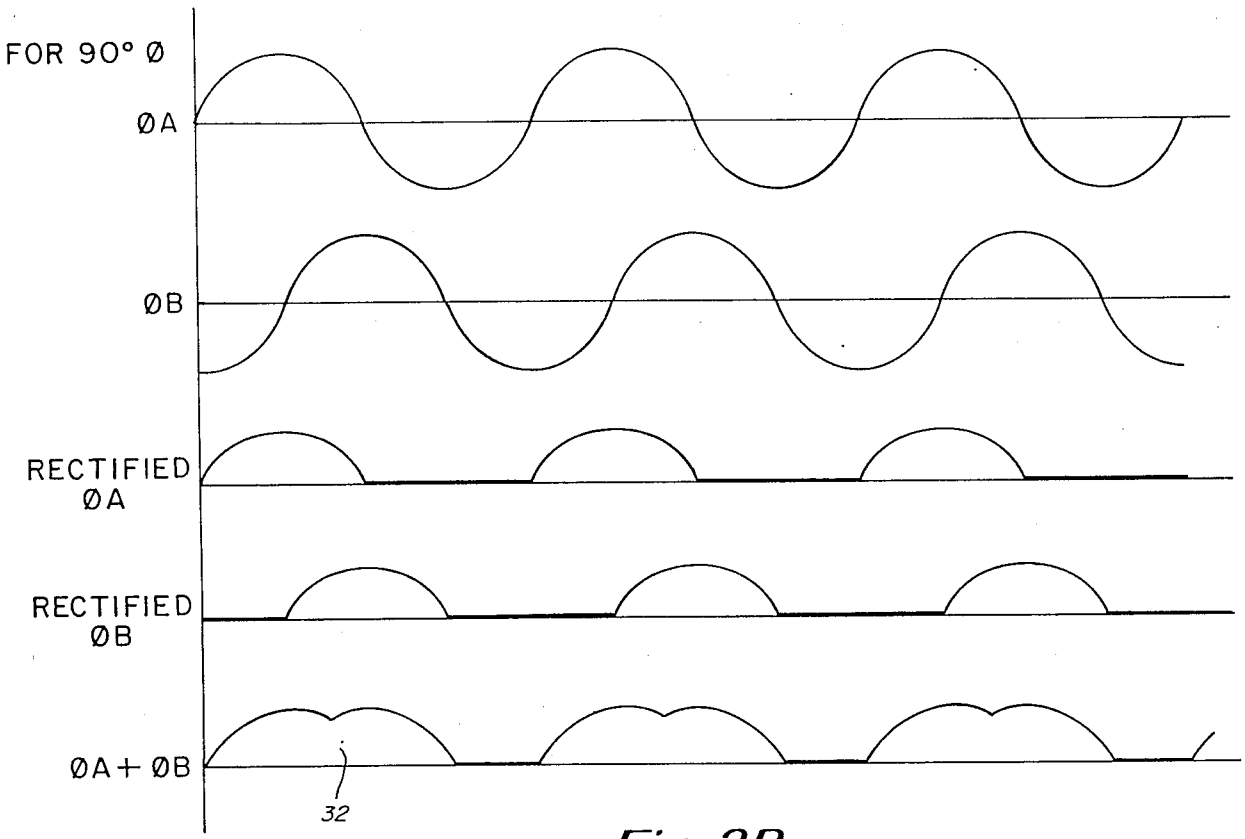
Figure 2C:
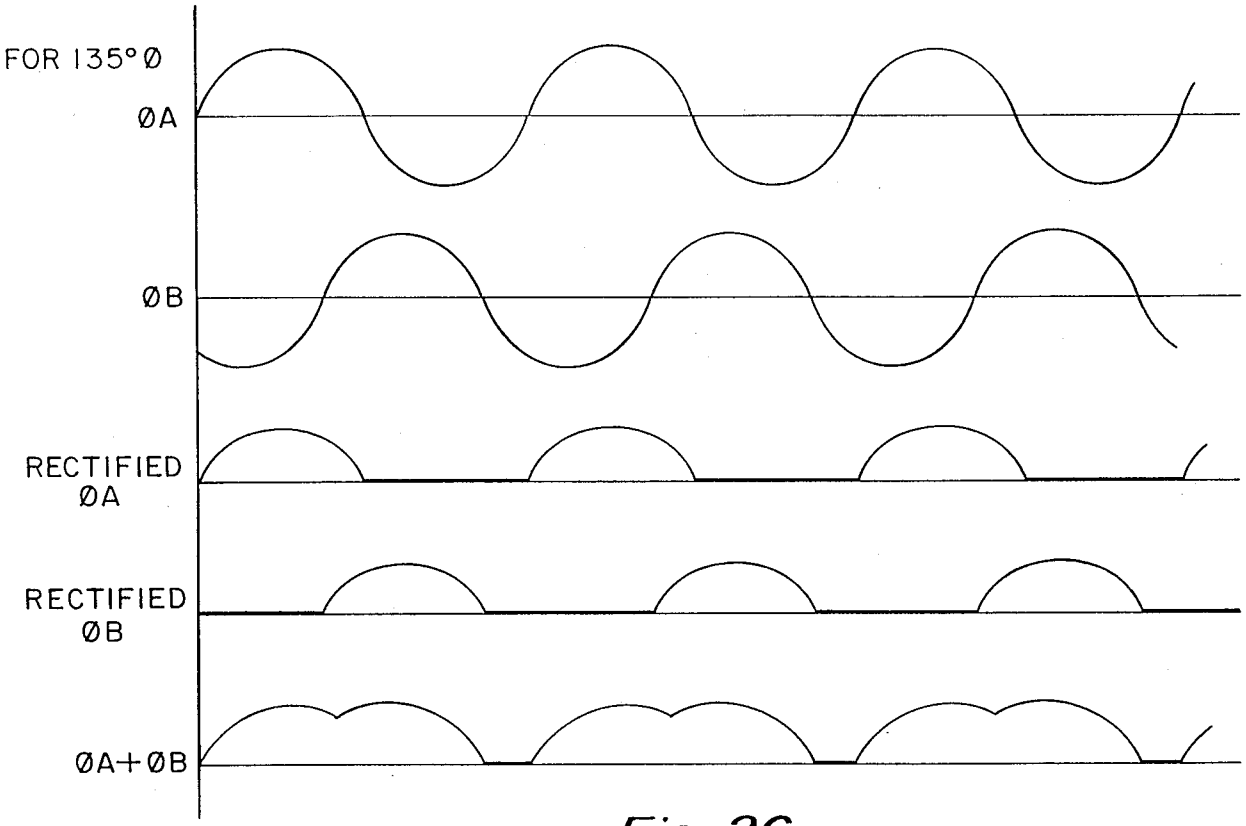
Figure 2D:
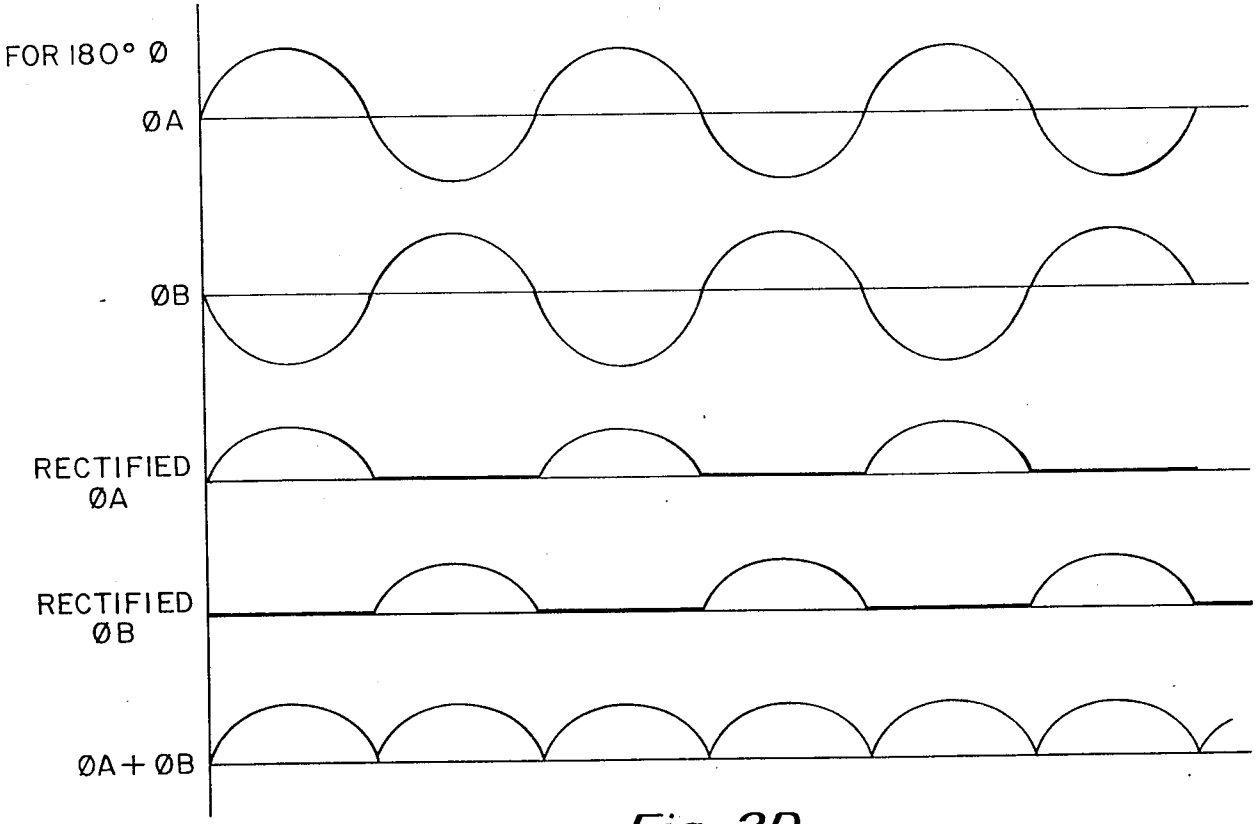

In connection with FIG. 2A as well as FIGS. 2B–2D, one can establish a duty cycle of operation which relates to the non-zero portion of the combined waveform as it relates to a complete cycle. The useful portion of the waveform is illustrated at 32 in FIG. 2A. The duty cycle in FIG. 2A is $\frac{5}{8}$ or 62.5% duty cycle. With the particular embodiment described herein, the minimum duty cycle is 50% at a phase angle of 0°. In FIG. 2A, the duration of the signal at 32 is approximately 10 milliseconds.

Now, FIG. 2B also illustrates the phase A and phase B signals as well as the rectified signals and finally illustrates the combined signal. It is noted that the useful part of the waveform at 32 which determines the x-ray exposure time is wider than in FIG. 2A and thus has an increased duty cycle of operation. The duty cycle in FIG. 2B is 6/8 or 75% duty cycle.

FIG. 2C represents a phase angle difference of 135° and it can be seen that with the final combined waveform that one is now approaching a more continuous signal level. The particular duty cycle of operation in FIG. 2 is $\frac{7}{8}$ or 87.5% duty cycle. Finally, FIG. 2D illustrates a continuous waveform in which the phase difference is 180°. Again, the particular phase angle selected is controlled at 20 in FIG. 1 by the amount of phase shift provided by phase shifter 14.

As indicated previously, at a 0° phase shift, there is provided the shortest duration pulse at a 50% duty cycle. This permits short exposures (i.e. 8 milliseconds or 1/120 seconds) and furthermore allows the necessary resetting of the iron core of the transformer by the inverse line voltage pulse. This is desired, as any power type of transformer saturates if pulses of the same polarity are passed through repetitively.

With respect to the prevention of saturation of the transformer, reference may now be made to FIG. 3 which shows a more detailed circuit diagram. In FIG. 3, the same reference characters are employed to identify similar parts of the circuit as previously identified in FIG. 1. Note in particular the series diode and resistor for reducing the amplitude of the inverse pulse in preventing saturation in the inverse direction. In FIG. 3 note more particularly the resistor R1 and diode D1 associated with rectifier 22 and the resistor R2 and diode D2 associated with rectifier 24. In FIG. 3, the half-wave rectifier circuits are of most simple construction employing a diode D3 in rectifier 22 and a diode D4 in rectifier 24.

FIG. 3 also shows the high voltage transformer 26 which actually is separated into first and second transformers T1 and T2. Each of these are step-up transformers. Transformer T1 has a primary winding P1 coupling to the half-wave rectifier and also has two secondary windings SA and SB. Similarly, the transformer T2 has a primary winding P2 coupling to the half-wave rectifier for phase B and also has secondary windings SC and SD. It is noted that the pairs of secondary windings in each transformer are grounded at the center as noted in FIG. 3.

In FIG. 3 the secondary windings of the transformers T1 and T2 couple to an output signal combining network 28 and that includes two separate bridge circuits. A first bridge circuit is comprised of diodes D5–D8 and the second bridge circuit is comprised of diodes D9–D12. In the first bridge circuit the diodes D5 and D6 couple signals to the x-ray tube 30 in the condition of positive reference signals. Similarly, with regard to the other bridge diodes D9 and D10 likewise couple signals to the x-ray tube 30. In the first bridge, the diodes D7 and D8 are shown uncoupled. Similarly, the diodes D11 and D12 in the second bridge are shown uncoupled. These diodes may be coupled into the circuit by closure of the switch contacts associated therewith, in the event of desiring full wave rectification at the output.

The output circuitry in FIG. 3 coupling to the x-ray tube 30 provides the signal combining as illustrated in FIGS. 2A–2D and in particular as illustrated in the last waveform of each of these drawings. For example, when the high voltage output from the secondary of the transformer T1 is providing a positive voltage through diodes D5 and D6 to the tube 30, thereafter, as this voltage waveform is decreasing, the phase relationship permits additional current to flow through the diodes D9 and D10 from the secondary of the second high voltage transformer. This thus continues to contribute to the exposure time and the drive voltage to the x-ray tube 30.

As indicated previously, the apparatus of the present invention is especially valuable where repetitive short duration x-ray exposures are desired, i.e., digital television fluoroscopy or radiography at 7.5, 15, 30 or 60 frames per second. Those rates are determined by the known parameters of television camera sweep systems and are synchronized with the zero points of the AC voltage wave.

Figure 2E:
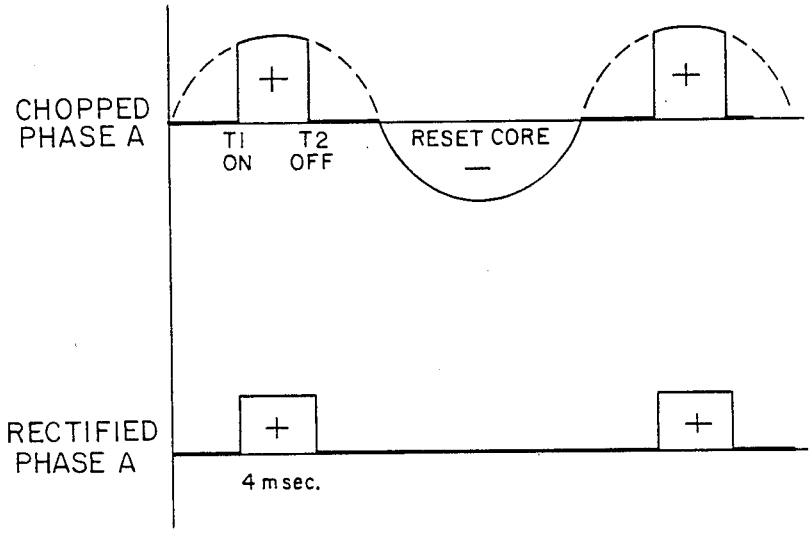
FIG. 2E illustrates waveforms associated with single phase control employing solid state switching devices.

Reference is now made to the further waveforms of FIG. 2E for an illustration of an alternate embodiment of the invention in which a single phase signal is employed. In this case there is a need for only a single local switching power supply in which solid state electronics provide for switching in which there is a chopped phase A signal as illustrated in FIG. 2E. This version which may employ "phase back" techniques can operate between 0.5 and 8 milliseconds. FIG. 2E also shows the associated rectified phase A signal. In this version, only a single tranformer is necessary and associated single half wave rectifier circuit. In essence, such an arrangement would use the top portion of the block diagram of FIG. 1 with the addition of a chopping circuit for providing the waveform illustrated in FIG. 2E.

In connection with the obtaining of the signal of FIG. 2E, as has been mentioned previously, SCR type devices or other solid state switching devices may be used to permit the signal to be turned on at some time after the zero of the sine wave. The SCR would then be turned off, as illustrated in FIG. 2E at a later time, thus shortening the duration of the sine wave. This operation provides the relatively square shaped waveforms of FIG. 2E.

In accordance with a further feature of the present invention, impedance is preferably automatically added to the primary or the transformer power supply during the unloaded portion of the sine wave voltage so that the saturation of the transformer core is avoided. This is illustated by the impedances in FIG. 1 associated with the networks 19 and 21.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A high voltage x-ray tube power supply which operates from single-phase alternating current and which produces a high voltage output which can be varied from periodic pulses with a pulse width of less than one cycle of said alternating current to a substantially continuous output, said supply comprising;

a plurality of low voltage switching power supplies, each of said power supplies generating a periodic sequence of low voltage pulses with the same frequency, each of said pulses consisting of a sine like signal of alternating current consisting of a first half cycle and a second half cycle, means for varying the phase of said periodic sequences relative to each other to adjust the x-ray exposure time, and voltage transforming means responsive to said low voltage pulses generated by said plurality of low voltage supplies for generating high voltage signals, said voltage transforming means including rectifier means for combining said high voltage signals for providing a high voltage output signal for operation of said x-ray tube.

2. A high voltage x-ray tube power supply according to claim 1 further comprising means for varying the phase of the low voltage pulse sequences produced by said plurality of power supplies to adjust the exposure rate.

3. A high voltage x-ray tube power supply according to claim 1 wherein said voltage transforming means comprises a plurality of high voltage transformers, each of said transformers having a primary winding connected to one of said low voltage power supplies and a secondary winding.

4. A high voltage x-ray tube power supply according to claim 1 wherein said rectifier means is responsive to the high voltage signals for combining said signals to generate said high voltage output signal, and a high voltage step-up transformer responsive to said low voltage pulses for generating high voltage output pulses for application to an x-ray tube.

5. A high voltage x-ray tube power supply according to claim 4 wherein said voltage transforming means comprises a high voltage transformer having a plurality of primary windings, each of said primary windings being connected to one of said low voltage power supplies and a secondary winding.

6. A high voltage x-ray tube power supply according to claim 1 wherein said phase varying means can adjust the relative of said periodic sequences relative to each other by phase angles ranging from 0° to 180°.

7. A high voltage x-ray tube power supply according to claim 1 wherein the duration of the sine like signal is reduced by using solid state switching devices permitting the signal to be turned on at some time after the zero of the sine like signal.

8. A high voltage x-ray tube power supply according to claim 7 incluing means to turn off the solid state device to shorten the duration of the sine wave signal.

9. Apparatus for supplying operating power to an x-ray generating source comprising;

means for receiving an input AC signal of first phase, means for shifting the phase of said first phase AC signal to thus provide a signal of second phase, a plurality of low voltage rectifier means including at least first and second rectifier means, means coupling said first phase signal to said first rectifier means, means coupling said second phase signal to said second rectifier means, and voltage transforming and combining means coupled from said first and second rectifier means for combining the signals therefrom and providing a high voltage output signal for operating said x-ray generating source.

10. Apparatus for supplying operating power to an x-ray generating source as defined in claim 9 including means for adjusting the phase shift to thereby adjust x-ray exposure time over a range of duty cycles including from repetitive short duration x-ray exposures to continuous x-ray exposures.

11. Apparatus for supplying operating power to an x-ray generating source as defined in claim 10 wherein said AC signal is a single phase signal having first and second half cycles.

12. Apparatus for supplying operating power to an x-ray generating source as defined in claim 11 wherein said rectifier means each comprise a half-wave rectifier circuit.

13. Apparatus for supplying operating power to an x-ray generating source as defined in claim 12 including inverse pulse suppression means associated with said rectifier means.

14. Apparatus for supplying operating power to an x-ray generating source as defined in claim 13 wherein said inverse pulse suppression means includes a diode and resistor coupled in series.

15. Apparatus for supplying operating power to an x-ray generating source as defined in claim 10 wherein said means for adjusting the phase shift through a range of 0° to 180°.

16. Apparatus for supplying operating power to an x-ray generating source as defined in claim 10 wherein said voltage transforming and combining means comprises a transformer means and an adder circuit means, said transformer means being coupled from said rectifier means and said adder circuit means coupled from said transformer means to said x-ray tube.

17. Apparatus for supplying operating power to an x-ray generating source as defined in claim 16 wherein said transformer means includes first and second step-up transformers each having a primary winding and at least one secondary winding, the primary windings coupling to respective first and second rectifier means.

18. Apparatus for supplying operating power to an x-ray generating source as defined in claim 17 wherein said adder circuit means includes first and second bridge circuits coupled from the secondary windings of the respective first and second transformers.

19. A method for supplying operating power to an x-ray generating source, comprising the steps of, providing a single phase input signal of a first phase, shifting the phase of the first phase AC signal to thus provide a signal of second phase, rectifying said first phase signal to provide a rectified first phase signal, rectifying said second phase signal to provide a rectified second phase signal, and combining said first and second rectified signals to provide a high voltage output signal for operating said x-ray generating source.

20. A method as set forth in claim 19 including adjusting the phase between the first and second phase signals to adjust the duty cycle of the high voltage output signal.

21. An apparatus for generating a power waveform that couples to an x-ray generating tube and that may extend in a range of providing pulsed x-ray exposures to continuous x-ray exposures, said apparatus comprising, means for providing an input signal having an input frequency, means for receiving said input signal for generating first and second signals of the same frequency including means for adjusting the phase difference between the first and second signals so that it maybe varied between 0° and 180°, means for half-wave rectifying said first signal, means for half-wave rectifying said second signal, means for combining said half-wave rectified first and second signals to form an output signal, said output signal having a time of zero voltage at a time when the output signal has a changing voltage which is synchronous with the input frequency of the input signal, and means for applying the output signal to the x-ray generating tube.

22. An apparatus as set forth in claim 21, including impedance means associated with said means for generating for providing an increased impedance path during the unloaded portion of the input signal.

23. A method for supplying operating power to an x-ray generating source, comprising the steps of: providing a multiple-phase input signal, converting the multiple-phase input signal into signals of first and second phase, rectifying said first-phase signal to provide a rectified first-phase signal, rectifying said second-phase signal to provide a rectified second-phase signal, and combining the first and second rectified signals to provide a high voltage output signal for operating said x-ray generator source.

24. A method as set forth in claim 23 including adjusting the phase between the first and second phase signals to adjust the duty cycle of the high voltage output signal.

25. A method for supplying operating power to an x-ray generating source, comprising the steps of: providing a low voltage single-phase input signal of a first phase, shifting the phase of the first-phase signal to thus provide a low voltage signal of second phase, converting said first and second phase low voltage signals to corresponding first and second high voltage signals, and combining the first and second high voltage signals to provide a high voltage output signal for operating the x-ray generating source.

26. A method as set forth in claim 25 including rectifying said low voltage first and second phase signals to provide rectified first and second phase signals.

27. A method as set forth in claim 26 wherein the step of combining includes a further step of rectifying said high voltage signals.

28. A method as set forth in claim 25 including adjusting the phase between the first and second phase signals to adjust the duty cycle of the high voltage output signal.

29. A method for supplying operating power to a x-ray generating source, comprising the steps of: providing a multi-phase input signal, converting the multi-phase input signal into first and second phase low voltage signals, converting the first and second phase low voltage signals to corresponding first and second high voltage signals, and combining said first second high voltage signals to provide a high voltage output signal for operating the x-ray generating source.

30. A method as set forth in claim 29 wherein the step of combining includes rectifying the first and second phase high voltage signals.

31. A method as set forth in claim 29 including adjusting the phase between the first and second phase signals to adjust the duty cycle of the high voltage output signal.

* * * * *